US005540563A

United States Patent [19]

Hansell

[11] Patent Number: 5,540,563

[45] Date of Patent: Jul. 30, 1996

[54] UNITARY HOUSING FOR DOUBLE HYDRAULIC UNIT

[75] Inventor: Jeffrey C. Hansell, Ames, Iowa

[73] Assignee: Sauer Inc., Ames, Iowa

[21] Appl. No.: 307,177

[22] Filed: Sep. 16, 1994

[51] Int. Cl.[6] ..... F04B 27/08

[52] U.S. Cl. ..... 417/269; 417/239

[58] Field of Search ..... 417/53, 239, 269, 417/271, 222.1; 418/210; 91/505, 506; 92/128, 59

[56] References Cited

U.S. PATENT DOCUMENTS

| | | | |
|---|---|---|---|
| 2,272,771 | 2/1942 | Hawley, Jr. | 91/505 |
| 2,662,375 | 12/1953 | Postel et al. . | |
| 2,672,095 | 3/1954 | Lucien et al. | 417/269 |
| 2,722,890 | 11/1955 | Lucien | 417/270 |
| 2,842,068 | 7/1958 | Sundin | 417/269 |
| 2,892,352 | 6/1959 | Saalfrank . | |
| 3,422,767 | 1/1969 | McAlvay | 91/505 |
| 3,442,181 | 5/1969 | Olderaan . | |
| 4,007,663 | 2/1977 | Nagatomo et al. | 417/269 |
| 4,142,452 | 3/1979 | Forster et al. | 91/506 |
| 4,534,271 | 8/1985 | Forster | 417/269 |
| 4,765,194 | 8/1988 | Van Meegen | 417/269 |
| 4,911,063 | 3/1990 | Kawahara et al. | 91/506 |
| 5,307,731 | 5/1994 | Chamberlain et al. | 92/147 |

FOREIGN PATENT DOCUMENTS

| | | | |
|---|---|---|---|
| 1107083 | 12/1959 | Germany | 417/269 |
| 1099357 | 2/1961 | Germany | 417/269 |
| 1634816 | 3/1991 | U.S.S.R. | 417/269 |
| 627290 | 8/1949 | United Kingdom | 417/269 |
| 800403 | 11/1954 | United Kingdom | 417/269 |

*Primary Examiner*—Charles Freay

*Attorney, Agent, or Firm*—Zarley, McKee, Thomte, Voorhees, & Sease

[57] ABSTRACT

A unitary housing for a hydraulic unit such as tandem pump, having a plurality of rotating groups driven in one direction about a common axis by a source of rotary power having a pair of opposite end walls generally transverse to the common axis, a continuous side wall connecting the end walls, and at least two apertures in the side wall which allow the insertion of a rotating group into the housing. The housing can also include a first flange on one of the end walls for mounting the housing to a source of rotary power. A second flange can be included on the other end wall for mounting an auxiliary pump to the main hydraulic unit. Alternatively, if the second flange is the same size as the first flange, the housing allows the user to change the rotation of the tandem pump by spinning the housing end-for-end and without changing any internal components.

14 Claims, 2 Drawing Sheets

UNITARY HOUSING FOR DOUBLE HYDRAULIC UNIT

BACKGROUND OF THE INVENTION

The present invention relates generally to swashplate-controlled hydraulic units which convert rotational power to fluid power and vice versa. The present invention relates to axial piston, variable displacement hydraulic pumps. More particularly, this invention relates to an improved unitary housing for axial piston hydraulic units having a plurality of rotary groups.

Various configurations of multiple pumps are known in the art of hydraulics. Two, three, or even more pumps have been coupled together so as to be driven by a single source of rotary power. One configuration known as a tandem pump or double pump is quite common.

A typical conventional tandem pump comprises a front pump having a housing and a shaft mounted to the source of rotary power and a rear pump having its own housing and shaft mounted to the rear of the front pump. The shafts of the front and rear pump are drivingly connected to each other by a coupling positioned between them. Each pump in the tandem pump combination has its own rotating group and swashplate. The rotating group includes a cylinder block and a plurality of axially reciprocable pistons mounted therein.

Each pump in the tandem also includes a valve plate for controlling the timing and direction of the fluid flow of the respective pump. The valve plate mates with the end of the cylinder block that is opposite from the swashplate. Bi-directional valve plates are known to improve the flexibility of hydraulic units by allowing the unit to be driven in either direction by a source of rotary power, but performance and efficiency have been lacking or compromised with these bi-directional valve plates. Therefore, existing tandem hydraulic units are usually built with valve plates of a specific porting configuration so as to correspond with the direction that the source of rotary power rotates. The surfaces of the cylinder blocks that mate with the valve plates generally face in the same direction in conventional tandem pumps. Therefore, each pump in the tandem must use a valve plate that has the same rotational configuration as the valve plate of the other pump and the source of rotary power.

Because of the uni-directional nature of most conventional hydraulic pumps, manufacturers and distributors can often have difficulty meeting customer demand for a unit of a particular rotation. If the hydraulic pump and the customer's source of rotary power are of opposite rotations, either a different hydraulic unit must be built from scratch or obtained otherwise. It is known in the art that it is sometimes quicker to partially disassemble and then convert a unit of incorrect rotation to a unit of the desired rotation by changing the valve plate. In fact, both valve plates in a tandem must be changed to complete the conversion. The known configurations of tandem pumps make it difficult for manufacturers and distributors to provide efficient units of the desired rotation without long delays or high inventory carrying costs.

Existing tandem pumps are also difficult to convert to a different rotation because the valve plate is located at the bottom of a stack of components such that it can only be removed through an opening at the end of the housing. Numerous other components must first be removed to expose the valve plate. The difficulty is compounded when the tandem pump has already been installed in the vehicle. The tandem pump may have to be disconnected from the source of rotary power before conversion can commence. If an auxiliary gear pump or the like is mounted to the rear pump, it may also have to be removed prior to attempting the conversion.

The pressure generated by the axial pistons of the hydraulic unit can reach several thousand pounds per square inch. This high pressure translates into large axial forces during the operation of the hydraulic unit. Conventional tandem pumps typically comprise two pump housings joined at a seam that is transverse to the direction of these major axial hydraulic forces. As a result, the large axial forces tend to separate the housings at their seam or joint and let fluid leak out. Various sealing means such as o-rings, seals, and gaskets have been tried to seal this joint. The long term reliability of such sealed joints remains a concern.

In order to restrain the housings against the separation forces caused by the axial hydraulic loads, various fastening systems have been tried along the seam or joint between them. Such fastening systems consume a great deal of space, and thereby require a housing which is larger than necessary. Since the size of the housing is a major factor in determining the overall size of the hydraulic unit, a larger housing means a larger hydraulic unit. Larger hydraulic units typically weigh more, require more materials, cost more and consume more space when installed.

Logically, the length of multiple pumps, tandem pumps included, can be quite long. Furthermore, auxiliary pumps, such as gear pumps, gerotor pumps, crescent pumps, vane pumps and the like are often mounted on an SAE pad at the back of the rear pump. As a result of this extended length and weight, auxiliary support brackets are sometimes required to relieve the stress and deflection which would otherwise occur at the seam (s) of the housings.

Therefore, a principle objective of the present invention is the provision of an improved housing for multiple hydraulic units.

A further object of this invention is to provide a housing for a multiple hydraulic unit that is more reliable and flexible.

A further objective of this invention is to provide a unitary hydraulic housing which eliminates seams or joints transverse to the direction of the major hydraulic separating forces.

A further objective of this invention is the provision of a multiple hydraulic unit assembly which can be adapted to the rotation of a source of rotary power without a major teardown of the unit.

A further objective of this invention is the provision of a tandem hydraulic unit assembly having identical mounting flanges at both ends of its housing and back-to-back cylinder blocks such that the rotation of the tandem can be changed by spinning or flipping the unit end-for-end.

A further objective of this invention is the provision of a unitary housing for a multiple hydraulic unit having a transverse aperture for the insertion and withdrawal of a rotating group and valve plate.

A further objective of this invention is the provision of a unitary housing for a multiple hydraulic unit that reduces the need for an auxiliary supporting bracket to be attached to the hydraulic unit in order to relieve stress and reduce deflection.

These and other objectives will be apparent to those skilled in the art.

SUMMARY OF THE INVENTION

The present invention is a unitary housing for an axial piston hydraulic unit, such as a tandem pump, having a plurality of rotating groups driven in one direction about a common axis by a source of rotary power. The unitary housing has a pair of opposite end walls that extend generally transverse to the common axis, a continuous side wall connecting the end walls, and at least two aperture in the side wall. The aperture are each of sufficient size and shape to allow the insertion of a rotating group therethrough. The unitary housing is also adapted to house the rotating groups adjacent to each other in a back-to-back configuration. Furthermore, the unitary housing can be constructed with identical mounting flanges at the front and rear end walls.

When a multiple hydraulic unit is assembled with the housing of this invention, the rotating groups can be inserted laterally into the housing through the aperture rather than longitudinally stacked through the openings in the end walls in a conventional manner. After initial assembly, a rotating group and/or a valve plate can be withdrawn through its respective lateral access aperture by partially withdrawing the corresponding shaft axially.

Each rotating group includes a cylinder block. A valve plate mates with the end of each cylinder block to insure proper porting of the high pressure fluid. The valve plate of each portion of the multiple hydraulic unit must be selected to correspond with the direction in which the source of rotary power drives the mating rotating group. The housing of this invention makes it possible to convert a multiple hydraulic unit to the opposite rotation by withdrawing the existing valve plate (s) laterally through the apertures (s) once the shaft has been axially withdrawn and inserting valve plate (s) of opposite rotation in their place.

Converting conventional multiple hydraulic units to a different rotation has typically involved a major teardown. The apertures in the housing of the present invention allow the valve plates, and thereby the rotation of the multiple hydraulic unit, to be changed without a time consuming and costly major teardown.

In the case of a multiple hydraulic unit having an even number of rotating groups, identical flanges can be provided on either end of the housing so that the hydraulic unit can be converted to the opposite rotation, without changing any internal parts, by flipping or spinning the unit end-for-end. Therefore, alternate way of changing the direction of rotation is provided by this invention. According to this embodiment of the invention, it is not necessary to teardown the unit or replace any of its internal components, including its valve plates.

The housing of this invention provides for more flexible and reliable multiple hydraulic units.

DETAILED DESCRIPTION OF THE PREFERRED EMBODIMENT

Figure 1:
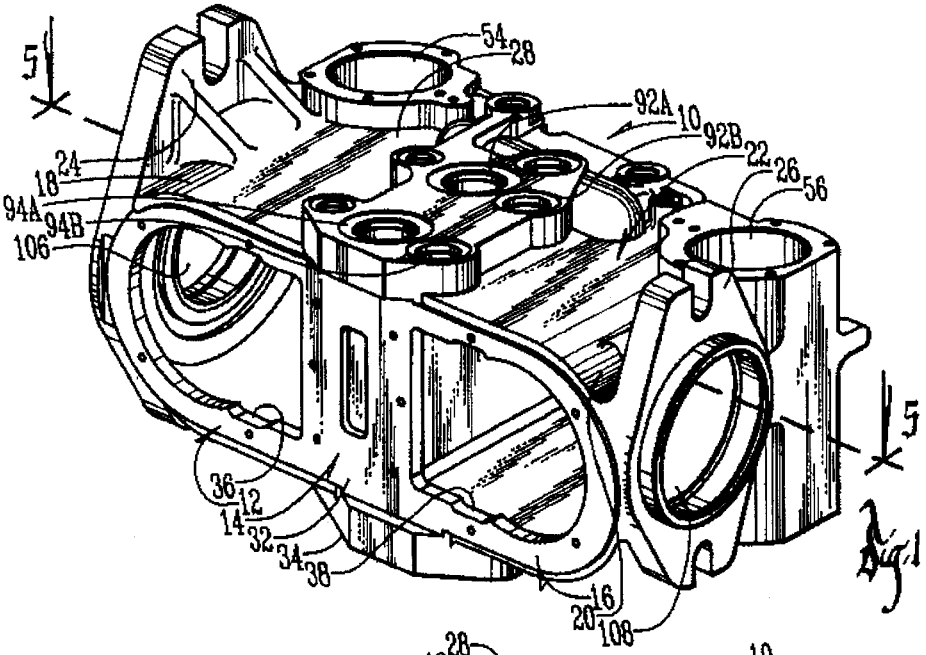
FIG. 1 is a perspective view of the unitary hydraulic housing of the present invention.

The unitary housing of the present invention is shown in FIGS. 1–5 and generally denoted by the reference numeral 10 therein. As seen in FIG. 1, the housing 10 includes a front portion 12, one or more center section portions 14, and one or more rear portions 16. The housing 10 has generally opposite end walls 18 and 20 and a side wall 22 extending therebetween that is free from any transverse seams or joints.

End wall 18 has a mounting flange 24 formed thereon, which may be used for attaching the housing 10 to a source of rotary power (not shown). End wall 20 has a similar mounting flange 26 formed thereon, which may be used for attaching an auxiliary pump 104 (see FIG. 5), such as a gear pump, a gerotor pump, vane pump, crescent pump or the like. Such auxiliary pumps are often used to provide relatively small amounts of fluid for various auxiliary needs while the tandem unit itself provides for the major fluid power needs of the vehicle or machine.

As shown in FIGS. 1–4, the side wall 22 has a top 28, opposite sides 30 and 32, and a bottom 34. Side 32 of side wall 22 has a pair of apertures 36 and 38 that open into the interior of front portion 12 and rear portion 16 respectively.

Figure 5:
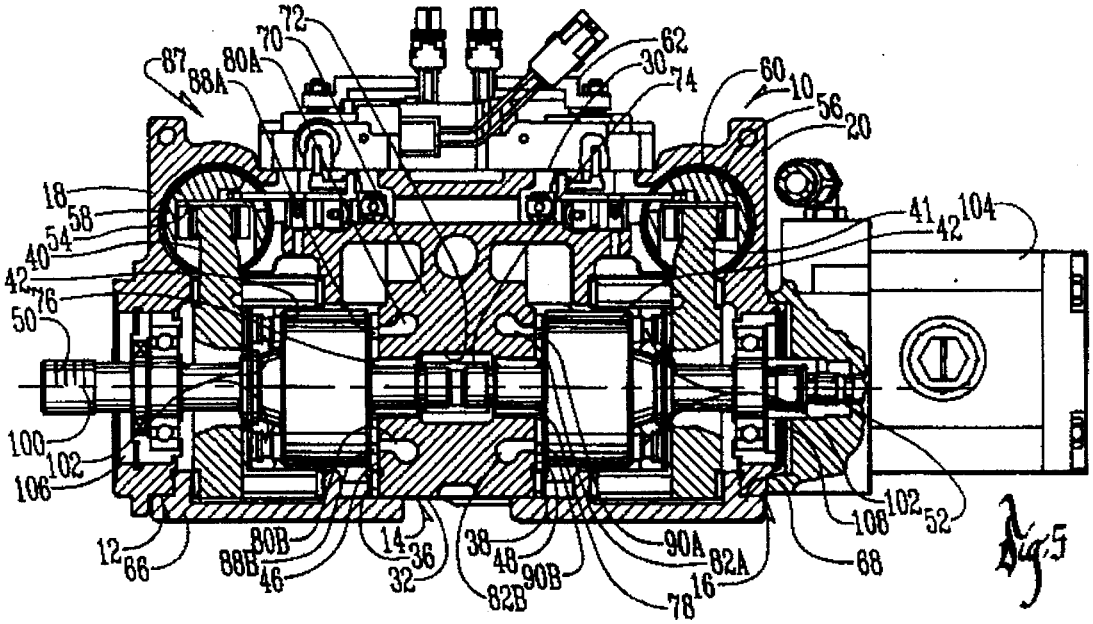
FIG. 5 is a cross-sectional view of a tandem pump equipped with the housing of this invention, an electronic control and an auxiliary pump. The housing, its contents, and the connection with the auxiliary pump are sectioned along line 5—5 of FIG. 1.

As best understood in view of FIG. 5, apertures 36 and 38 are shaped. and sized so as to accommodate the insertion and withdrawal of a swashplate 40 or 41, a cylinder block 42 housing a plurality of reciprocable pistons 102 and respective valve plates 46 and 48 when the respective shafts 50 and 52 are absent or removed from the unitary housing 10. Preferably, the apertures 36 and 38 each have substantially straight and vertical edges 31 or 33 at one end, generally straight top edges 35 or 37 and bottom edges 39 or 49 which are generally parallel to top edge 35, 37, and an arcuate edge 45 or 47 opposite the straight vertical edge 31 or 33 (see FIG. 2). One of skill in the art will notice from FIGS. 2 and 5 that the profile of apertures 36 and 38 is essentially the same as that of a swashplate, cylinder block, and valve plate stacked together. The apertures 36 and 38 are also disposed on the housing 10 such that their straight vertical edges 31 and 33 are proximate to each other, but do not touch. In other words, the apertures are spaced apart but positioned in a back-to-back manner. As a result, cylinder block 42 (right), valve plate 48, and swashplate 41 preferably face a different direction than cylinder block 42 (left), valve plate 46, and swashplate 40 when inserted into the housing 10 (see FIG. 5).

Figure 2:
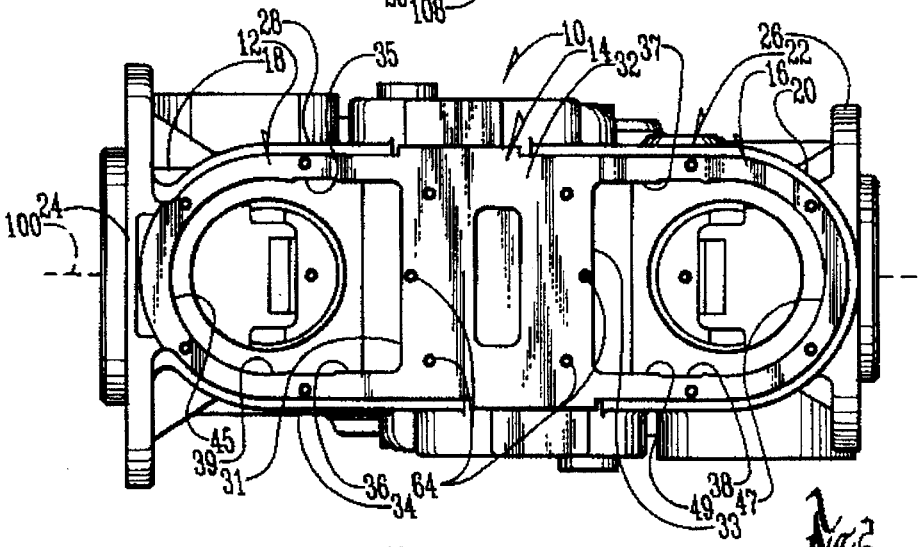
FIG. 2 is a front elevation view of the housing of FIG. 1.
Figure 3:
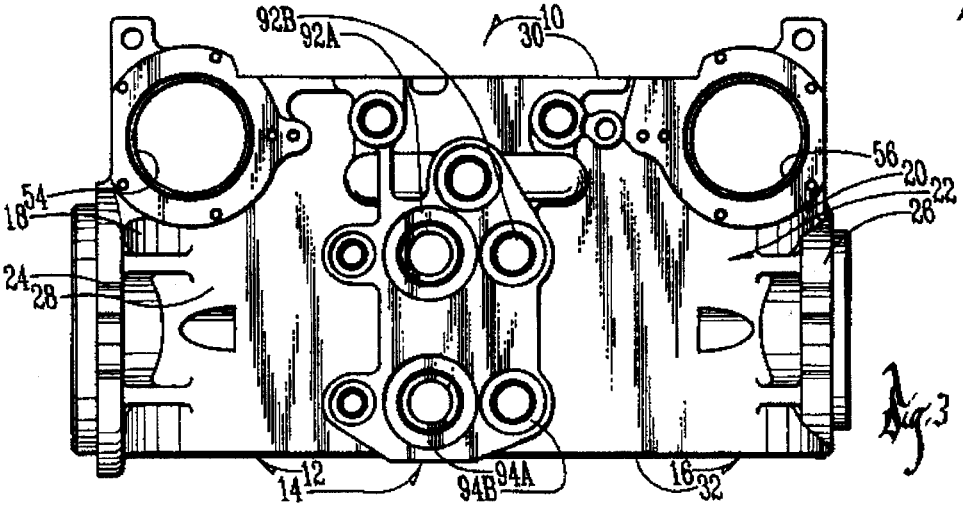
FIG. 3 is a top plan view of the housing of FIG. 1.
Figure 4:
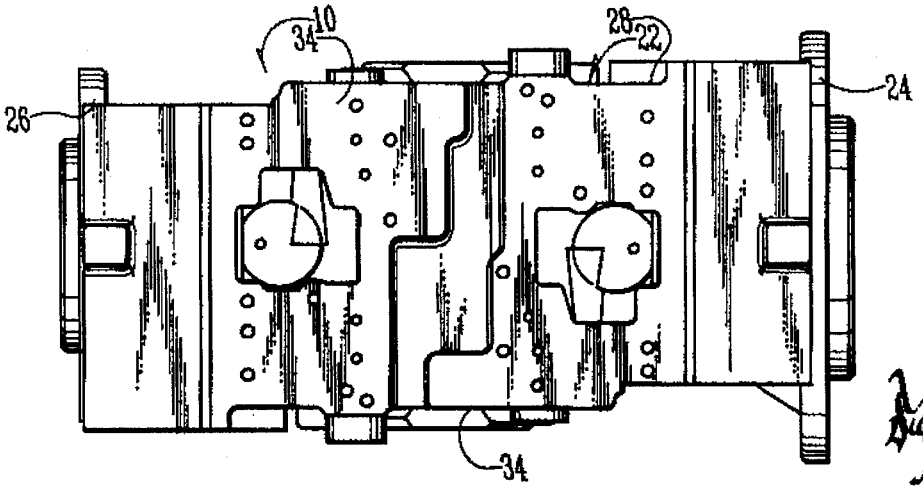
FIG. 4 is a bottom view of the housing of FIG. 1.

FIG. 2 shows that a plurality of threaded bolt holes 64 are provided adjacent to each aperture 36 and 38. As seen in FIG. 5, cover plates 66 and 68 are bolted or otherwise conventionally attached to side wall 22 with a conventional sealing means, such as a gasket (not shown), interposed therebetween to prevent fluid from leaking through the respective aperatures.

Servo bores 54 and 56 extend through the side wall 22 and are offset from the pistons 102. The servo bores 54 and 56 receive servo pistons 58 and 60 respectively, which are connected by conventional means to the respective swashplates 40 and 41. The position of each swashplate 40 or 41, and thus the fluid displacement of the pump, is independently controllable in a conventional manner, such as with a displacement control 62 that is preferably electrically or manually operated. The displacement control 62 shown in FIG. 5 is manually operated, but includes as accessories not critical to the present invention an override solenoid and two backup alarm switches. Thus, corresponding electrical connections are also seen in FIG. 5. The displacement control 62 converts an input command into a hydraulic command signal that is routed to either end of the servo pistons 58 and 60 in their respective bores 54 and 56.

The servo pistons 56 and 58 connect the control 62 to respective swashplates 40 and 41 so as to tilt them with respect to the axis of rotation 100 of shafts 50 and 52 Thereby, the stroke of the axial pistons 102 and therewith the fluid displacement of the front pump 84 and rear pump 86 is independently adjustable in a manner that is well known in the art.

In FIG. 5, the center section 14 of housing 10 is shown to include an upright wall 70 extending inwardly from and integral to the side wall 22. A bore 72 extends longitudinally through the upright wall 70 to accommodate the proximate ends of shafts 50 and 52, as well as a conventional coupling 74 and conventional bearings 76 and 78 The upright wall 70 also includes pairs of high pressure passages 80A and 80B and 82A and 82B corresponding respectively to front and rear pumps 84 and 86 of tandem pump 87. High pressure passages 80A, 80B, 82A, 82B extend from ports 88A, 88B, 90A and 90B in the valve plates 46 and 48 to ports 92A, 92B, 94A and 94B on an outer surface of the side wall 22 of the housing 10. Other conventional ports are provided, but it should be noted that the high pressure ports and the other conventional ports are all located on the top 28 of the side wall 22. The consolidation of the hydraulic ports on a single surface of housing 10 makes it more convenient to install and service the tandem pump 87 This feature also makes it easier to cast and machine the housing 10.

FIG. 5 shows that the housing 10 has an opening 106 in the front end wall 18 for allowing shaft 50 to protrude from the housing. Furthermore, an opening 108 can be provided in the rear end wall 20 for the shaft 52 to extend therethrough. This allows a conventional auxiliary pump 104 such as a gear pump, to be coupled and mounted to the rear pump. With the appropriately sized and configured rear mounting flange 26, the rear pump rather than the front pump can be mounted to a source of rotary power.

Figure 6:
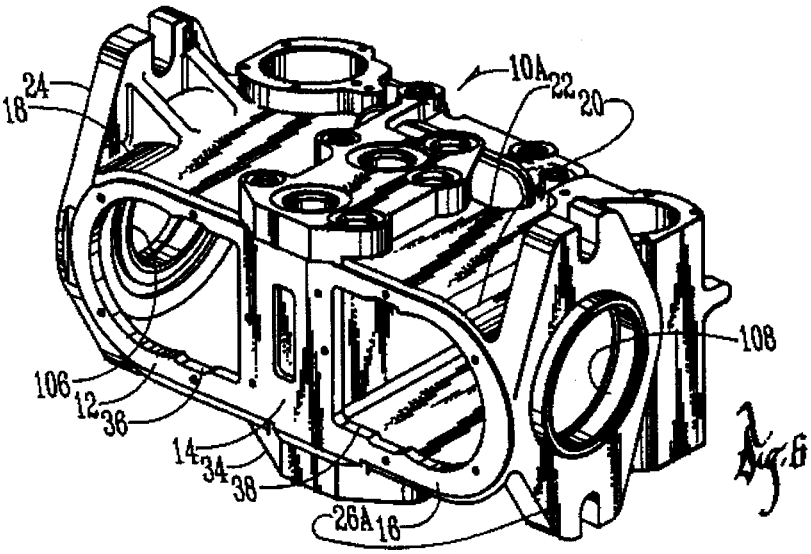
FIG. 6 is a perspective view similar to FIG. 1, but shows the housing having identical front and rear mounting flanges to facilitate reversibility.

For purposes of illustration only, mounting flange 24 has been shown in FIGS. 1–5 as an SAE C pad and mounting flange 26 has been shown as an SAE B pad. It should be noted that flanges 24 and 26 may be adapted to other standard sizes or to particular customer requirements without detracting from this invention. For instance, one particularly advantageous combination is contemplated wherein an identical configuration, such as SAE C pad, is provided on both flanges (see 24 and 26A, in FIG. 6) so the rotation and location of the front and rear pumps may be reversed merely by spinning or flipping the tandem pump end-for-end. As best seen in FIG. 5 and 6, the tandem pump 87 can be built with a housing 10A having a flange 26A on the rear pump which is identical to the flange 24 on the front pump. The rear shaft 52, rather than the front shaft 50, can then be connected to the source of rotary power.

Because shafts 50 and 52 are connected by the coupling 74, they rotate in unison and in the same direction. However, when looking into the distal ends of each shaft 50 and 52, they appear to rotate in different directions. An example will further illustrate this phenomena and show how the tandem pump housing 10A makes advantageous use of it.

Suppose the source of rotary power has a shaft that when viewed from the output end rotates in a clockwise or right hand direction. To be driven by such a source of rotary power, the front pump of tandem pump 87 must have a right-handed or clockwise valve plate. Because the cylinder blocks 42 face in opposite directions (see FIG. 5), the rear pump 86 of tandem pump 87 must have a left-handed or counter-clockwise rotation valve plate 48, which faces in the opposite direction as well. With this configuration, the tandem pump 87 can easily be adapted to be driven by an oppositely directed source of rotary power without changing any internal parts. The tandem pump 87 is merely spun end-for-end so the rear (left hand or counter-clockwise rotation) pump effectively becomes the front pump and the front (right-handed or clockwise rotation) pump effectively becomes the rear pump. Thereafter, shaft 52 can be driven by the counter-clockwise source of rotation and the tandem pump 87 will respond with efficient and proper output flows. Using the housing 10A of this invention with identical mounting flanges thereon, no part changes are required to change rotation. Furthermore, the reversible tandem still utilizes unidirectional valve plates rather than less efficient conventional bi-directional valve plates.

Finally, one skilled in the art can appreciate that the housing 10 of this invention is longitudinally compact and without a transverse seam, joint or gasket. This eliminates the need for auxiliary mounting brackets typically used on existing multiple pumps to support the rear of the housing and reduce stresses and deflection at such seams.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A housing for a hydraulic unit having a plurality of rotating groups driven in one direction about a common axis by a source of rotary power, the housing comprising:

a pair of opposite end walls extending generally transverse to the common axis;

a continuous side wall connecting the end walls;

at least two aperture in the side wall, each aperture being of sufficient size to allow the insertion of one of the rotating groups.

2. The housing of claim 1 wherein a first flange is disposed on one of the end walls for mounting the housing to the source of rotary power.

3. The housing of claim 2 wherein a second flange is disposed on the other of the end walls.

4. The housing of claim 1 wherein the side wall has a top face and a bottom face and opposite side faces and the two aperture are both disposed on the same face.

5. The housing of claim 4 further comprising a pair of high pressure hydraulic ports for each rotating group, the ports being disposed on the top face of the side wall of the housing.

6. The housing of claim 1 wherein the side wall has a top, a bottom, and opposing sides and the apertures are both located on one of the opposing sides.

7. The housing of claim 6 wherein the apertures are elongated and each have a substantially straight and vertical edge connecting a pair of generally horizontal and parallel side edges, and an arcuate edge connecting the side edges opposite the vertical edge.

8. The housing of claim 7 wherein the apertures are arranged with the vertical edge of one aperture spaced apart and generally parallel to the vertical edge of the other aperture such that the apertures are in a back-to-back condition, whereby the rotating groups must also be in a back-to-back condition to pass through.

9. A reversibly mountable tandem hydraulic pump, comprising:

a pair of rotatable cylinder blocks having a plurality of axially reciprocating pistons therein;

at least one shaft having opposite ends and an intermediate portion therebetween, one end being attached to a source of rotary power and the intermediate portion being drivingly connected to the cylinder blocks;

a housing having a pair of end walls extending transversely to the shaft, each of the end walls having a flange disposed thereon, and continuous side wall connecting the end walls, the side wall having a pair of apertures opening transversely to the shaft for inserting the rotatable cylinder blocks, the shaft and a swashplate into the housing the second flange has a male mounting pilot thereon having a diameter of approximately four inches.

10. A method of converting a multiple hydraulic unit originally built to be rotated in one direction to be rotated in an opposite direction, comprising:

providing a multiple hydraulic unit having a plurality of shafts drivingly engaging and laterally restraining a corresponding plurality of rotating groups with a unidirectional valve plate corresponding to each of the rotating groups also being laterally restrained by one of the shafts, the rotating groups and the valve plates being oriented within a unitary housing so as to rotate about a common axis so as to permit hydraulic flow through the unidirectional valve plates when rotated in one direction, the housing having opposite end walls generally transverse to the common axis and a continuous side wall with at least two apertures therein of sufficient size so the rotating groups and the valve plates can pass through;

withdrawing one of the shafts axially so as to free the corresponding valve plate for lateral movement;

removing the corresponding valve plate from the housing through one of the apertures;

exchanging the removed valve plate for a different valve plate adapted for the opposite direction of rotation; and inserting the different valve plate adapted for the opposite rotation into the housing through the same aperture used during the removal step.

11. The method of claim 10 wherein the removal and insertion of the valve plates is done with a lateral sliding motion.

12. A method of converting a tandem hydraulic unit originally built to be rotated in one direction to be rotated in an opposite direction, comprising:

providing a tandem hydraulic unit having two valve plates and mating rotating groups and a housing that is free of transverse seams, the housing including opposing transverse end walls each having identical mounting flanges; and spinning the tandem hydraulic unit end-for-end to allow the unit to be rotated in the opposite direction.

13. A housing for a hydraulic unit having a plurality of rotating groups driven in one direction about a common axis by a source of rotary power, the housing comprising:

a pair of opposite end walls extending generally transverse to the common axis;

a continuous side wall connecting the end walls;

at least two aperture in the side wall, each aperture being of sufficient size to allow the insertion of one of the rotating groups;

one of the end walls having a first flange for mounting the housing to the source of rotary power; and a second flange disposed on the other of the end walls;

the first flange being adapted to mount to a mounting pad of one size and the second flange being adapted to mount to a mounting pad of another size.

14. The housing of claim 13 wherein the first flange has a male mounting pilot thereon having a diameter of approximately five inches and the second flange has a male mounting pilot thereon having a diameter of approxiametly four inches.

* * * * *

UNITED STATES PATENT AND TRADEMARK OFFICE

CERTIFICATE OF CORRECTION

PATENT NO. : 5,540,563

DATED : July 30, 1996

INVENTOR(S) : Jeffrey C. Hansell

It is certified that error appears in the above-indentified patent and that said Letters Patent is hereby corrected as shown below:

Column 7, lines 12, 13 and 14 delete - the second flange has a male mounting pilot thereon having a diameter of approximately four inches -.
Column 8, line 21, delete "aperture" and insert - apertures -.

Signed and Sealed this

Twenty-second Day of October, 1996

*Attest:*

Bruce Lehman

BRUCE LEHMAN

*Attesting Officer*

*Commissioner of Patents and Trademarks*